US009004890B2

(12) United States Patent
Tomzik et al.

(10) Patent No.: US 9,004,890 B2
(45) Date of Patent: Apr. 14, 2015

(54) GEAR WHEEL PUMP

(75) Inventors: Arkadiusz Tomzik, Bergisch Gladbach (DE); Ulrich Helbing, Burscheid (DE); Dietrich Witzler, Rommerskirchen (DE); Michael Baumann, Flein (DE); Frank Herre, Oberriexingen (DE); Martin Stiegler, Steinheim (DE); Herbert Martin, Weinstadt (DE); Thomas Appel, Bönnigheim (DE)

(73) Assignees: Oerlikon Textile GmbH & Co. KG, Remschied (DE); Durr Systems GmbH, Bietigheim-Bissingen (DE)

( * ) Notice: Subject to any disclaimer, the term of this patent is extended or adjusted under 35 U.S.C. 154(b) by 1312 days.

(21) Appl. No.: 12/531,650

(22) PCT Filed: Mar. 11, 2008

(86) PCT No.: PCT/EP2008/052849

§ 371 (c)(1),
(2), (4) Date: Feb. 16, 2010

(87) PCT Pub. No.: WO2008/113712

PCT Pub. Date: Sep. 25, 2008

(65) Prior Publication Data

US 2010/0278676 A1 Nov. 4, 2010

(30) Foreign Application Priority Data

Mar. 20, 2007 (DE) ..... 10 2007 013 161

(51) Int. Cl.
*F01C 21/00* (2006.01)
*F04C 15/00* (2006.01)

(Continued)

(52) U.S. Cl.
CPC . *F04C 2/18* (2013.01); *F04C 2/086* (2013.01); *F04C 13/005* (2013.01); *F04C 15/0038* (2013.01)

(58) Field of Classification Search
CPC ..... F04C 15/0038; F04C 13/005; F04C 2/086
USPC ..... 418/205, 206.4, 206.6, 206.7, 183, 186, 418/187, 188; 464/7, 182
See application file for complete search history.

(56) References Cited

U.S. PATENT DOCUMENTS 259,640 A * 6/1882 Harrison et al. ..... 2/118
2,714,856 A * 8/1955 Kane ..... 418/132

(Continued)

FOREIGN PATENT DOCUMENTS

EP 1 164 293 12/2001
WO WO 2005/079302 9/2005

OTHER PUBLICATIONS

International Preliminary Report on Patentability for International Application No. PCT/EP2008/052849 issued Oct. 6, 2009.

(Continued)

*Primary Examiner* — Mary A Davis
*Assistant Examiner* — Anthony Ayala Delgado
(74) *Attorney, Agent, or Firm* — Alston & Bird LLP

(57) ABSTRACT

The invention relates to a gear wheel pump with two meshing gear wheels which are rotatably mounted within a pump housing by means of a driven driveshaft and a crankshaft journal and which form a pumping channel system between a pump inlet and a pump outlet. Several gaps are formed between the pump housing, the gear wheels, the driveshaft, and the crankshaft journal. One of the gaps between the driveshaft and one of the gear wheels contains means for the rotationally fixed connection of the driveshaft to the gear wheel. In order to prevent leakages penetrating to the connecting means, according to the invention the gap between the driveshaft and the gear wheel is sealed, with respect to the front faces of the gear wheel, by means of a sealant.

17 Claims, 6 Drawing Sheets

(51) Int. Cl.

| | |
|---|---|
| ***F01C 1/18*** | (2006.01) |
| ***F01C 1/24*** | (2006.01) |
| ***F04C 2/18*** | (2006.01) |
| ***F04C 2/08*** | (2006.01) |
| ***F04C 13/00*** | (2006.01) |

(56) References Cited

U.S. PATENT DOCUMENTS

| | | | | | |
|---|---|---|---|---|---|
| 2,801,593 | A | * | 8/1957 | Moshacher | 418/182 |
| 2,997,960 | A | * | 8/1961 | Kimijima et al. | 418/79 |
| 3,059,584 | A | * | 10/1962 | Cottell | 418/142 |
| 3,173,374 | A | * | 3/1965 | Beimfohr | 418/131 |
| 3,299,825 | A | * | 1/1967 | Bjørndal | 418/205 |
| 3,752,609 | A | * | 8/1973 | Niemiec et al. | 418/133 |
| 4,382,756 | A | * | 5/1983 | Chronowski et al. | 418/133 |
| 4,400,147 | A | * | 8/1983 | Springer et al. | 418/206.4 |
| 4,448,256 | A | | 5/1984 | Eberhardt et al. | |
| 4,595,349 | A | * | 6/1986 | Preston et al. | 418/206.1 |
| 4,940,394 | A | * | 7/1990 | Gibbons | 417/283 |
| 5,338,167 | A | * | 8/1994 | Berges | 418/104 |
| 6,050,795 | A | * | 4/2000 | Bodzak et al. | 418/69 |
| 6,183,231 | B1 | | 2/2001 | Van Norman | |
| 6,206,666 | B1 | * | 3/2001 | Steinrock et al. | 418/110 |
| 6,406,280 | B1 | * | 6/2002 | Pfeiffer et al. | 418/70 |
| 6,481,990 | B2 | * | 11/2002 | Wong et al. | 418/82 |
| 7,043,180 | B2 | * | 5/2006 | Askren et al. | 399/265 |
| 7,309,218 | B1 | | 12/2007 | Lewis et al. | |
| 2002/0085940 | A1 | * | 7/2002 | Bodzak | 418/182 |
| 2006/0120856 | A1 | * | 6/2006 | Tomzik et al. | 415/121.3 |

OTHER PUBLICATIONS

International Search Report for International Application No. PCT/EP2008/052849.

Orlov, P. I., Grundlagen der Konstruktionslehre, Moskau, Maschinenbau, Bd. 2, (1997), pp. 281 and 326.

* cited by examiner

GEAR WHEEL PUMP

BACKGROUND OF THE INVENTION

1. Field of the Invention

The invention concerns a gear pump, especially for conveying paints according to the preamble of claim 1.

2. Description of Related Art

A generic gear pump is known from DE 10 2005 016 670 A1. The known gear pump has two intermeshing gears, which are mounted to rotate within a pump housing through a drive shaft and journal. The gears, together with a pump inlet and a pump outlet, form a feed channel system within the pump housing, in order to convey paint in liquid or powdered form. To prevent paint residues from emerging from the feed channel system through the gap formed between the pump housing and the gears and being distributed over the gap within the pump housing, seals are provided between the front faces of the gears and the pump housing. A flushing channel system is also formed within the pump housing, in order to flush out possible paint residues from the gaps between the pump housing, gears, drive shaft and journal during a paint change.

The known gear pump can already be recognized from the combination between front sealing of the gears and the subsequently arranged flushing channel system, in that such sealing systems, because of continuous friction, are subject to increased wear. To this extent, only limited sealing of the gap on the front faces of the gears relative to the fixed pump housing can be achieved. In addition, higher sealing forces in the front area of the gears would only lead to an undesired increase in drive power.

Another problem in the gear pump known in the prior art results from the fact that dead spaces are created by the connection devices arranged in the gap between the drive shaft and the gear, which cannot be freed of paint residues by flushing. Because of the rotational movement of the drive shaft and the gear, such paint residues, however, propagate in an undesired fashion, so that undesired contamination cannot be ruled out.

A gear pump is known from EP 1 164 293 A2, in which the feed channel system and the flushing channel system are connected within the pump housing only by the gap between the pump housing, the gears, the driveshaft and the journal. To this extent, the paint residues that reach the gap can be removed by intensive flushing. However, in the known gear pump, the driveshaft is connected to the gear by force-fit, which, however, hampers simple disassembly and assembly between the driveshaft and the gear.

The task of the invention is to modify a gear pump of the generic type, so that the gap connected to the feed channel system can be easily flushed within the pump housing.

Another objective of the invention is to provide a gear pump of the generic type, in which assembly and disassembly possibilities are retained even after longer operating times.

SUMMARY OF VARIOUS EMBODIMENTS

This task is solved according to the invention in that the gap between the driveshaft and the gear is sealed by a packing relative to the front faces of the gear.

Advantageous modifications of the invention are defined by the features and feature combinations of the dependent claims.

The invention has the special advantage that the region poorly accessible for cleaning agents between the driveshaft and the gear is kept free of paint residues. The connection devices provided between the gear and the driveshaft can therefore be designed removable without producing undesired poorly flushable dead spaces. By sealing the connection site between the gear and the driveshaft, shape-mated connections are retained in a predefined fashion. Jamming of the connection devices between the driveshaft and gear, because of paint residues or other conveyed media, cannot occur. The connection between the driveshaft and the gear can therefore be easily loosened during maintenance work.

In order to obtain uniform sealing of the gap between the driveshaft and gear relative to the front faces, the packing is preferably formed by two sealing rings arranged at a distance from each other on the periphery of the driveshaft, the distance between sealing rings being equal to or less than the width of the gear. The gap can be sealed essentially over the full width of the gear, so that no or only small transitional areas of the gap remain accessible.

Depending on the arrangement of the sealing rings, which can be held both radially in peripheral sealing grooves in the periphery of the driveshaft and/or radially in peripheral sealing grooves in the periphery of a hole of the gear, the sealing surfaces can be made, both on the periphery of the driveshaft and in hole sections of the gear.

The modification of the invention, in which several diameter steps are formed between the driveshaft and the gear, is particularly preferred, the connection device being held between the driveshaft and the gear in one of the diameter steps. The surfaces for sealing function and the surfaces to accommodate the connection devices can therefore be separated from each other. In addition, simple assembly and disassembly work can be carried out between the gear and the driveshaft without influencing the sealing surfaces.

The sealing rings are preferably included in the diameter steps between the driveshaft and the gear, which include the diameter step to accommodate the connection device.

In order to obtain a splined connection between the driveshaft and the gear, the invention variant in which the connection device is formed by a pin is preferred, which is firmly connected to the driveshaft and engages in a shaped groove of the gear. High torques can therefore be reliably transferred.

The shaped groove of the gear is then preferably introduced into a hole offset of the gear formed between two diameter steps. The pin fastened in the driveshaft can therefore be guided by simple insertion into the shaped groove, so that joining of the gear and driveshaft can be accomplished without greater expenditure of force.

However, as an alternative, there is also the possibility of forming the connection device by a polygonal shape of the driveshaft, which cooperates with a polygonal shape of the hole of the gear. The polygonal shape is preferably introduced to the middle diameter step of the driveshaft or gear hole. This modification of the invention is particularly suitable for applying the highest possible torques.

Independently of the design of the driveshaft and gear hole, however, there is also the possibility of forming the connection device with at least one spring-loaded detent, which is held on the periphery of the driveshaft, and which engages in a recess of the gear hole. Both stepped and unstepped driveshafts can be used here.

In a particularly preferred modification of the invention, a flushing channel system is formed by several flushing channels, through which the bearing position of the driveshaft can be flushed from the outside in over its length. The flushing liquid flowing from the outside in therefore guides the paint residues back into the pump interior, in order to flush them outward through the pump inlet or pump outlet. This modification is particularly suitable for gear pumps used in painting equipment with a frequent color change. The flushing channel system permits rapid and intensive cleaning of the gear pump without any disassembly.

In order to keep the gap that forms between the gears and the pump housing within the narrowest possible tolerances with high sealing effect, according to a preferred modification of the invention, the pump housing is made in several parts, in which the front faces of the gears are held between two housing plates and the driveshaft is mounted to rotate directly on the mounting hole of the housing plate with at least one shaft section. The plate design permits precision machining of the pump housing, so that high plane-parallelism can be adjusted between the gears and the housing plates.

To implement a particularly compact design according to an advantageous modification of the invention, a sealing housing is allocated pressure-tight to the pump housing, which is penetrated by the driveshaft at a recess designed concentric to the driveshaft, and which encloses a packing arranged on the periphery of the driveshaft. The housing plate used to support the driveshaft can therefore be made narrow according to the bearing requirements. The packings can then be connected directly on the periphery of the driveshaft and are held by the sealing housing tight against the housing plate.

A gland packing and a clamping device that acts on the gland packing are advantageously used as packing. Sealing relative to high operating pressures within the pump housing can therefore be achieved. In particular, back-transport of the paint is possible, in order to initiate a color change. For this purpose, the driveshaft can be driven with alternating direction of rotation.

In another advantageous design of the invention, it is proposed that a support bearing for radial and axial support of the driveshaft is formed on a coupling section of the driveshaft extending outside the pump housing, which is formed by a support ring or a roller bearing. The support ring or roller bearing is preferably held between a support housing and a shaft offset of the driveshaft. The support housing is firmly connected to the pump housing, the seals being arranged to seal the gap caused by the driveshaft in the support housing or a sealing housing arranged in front. This modification is characterized by the fact that both internal pressure forces and forces acting from the outside on the driveshaft can be advantageously taken up outside the pump housing by a separate support bearing. By axial support of the driveshaft, pressure forces acting on the driveshaft can be advantageously taken up, so that the gear fastened to the driveshaft can be guided on the front faces essentially free of wear relative to the pump housing. The operating time is therefore increased, since wear on the gears is substantially reduced.

In order to avoid paint deposits in the annular gaps outside the pump housing with progressing operating time because of minimal leakage, according to a preferred modification of the invention, a shaft sealing ring is arranged within the support housing on the periphery of the driveshaft and a blocking liquid is filled into the annular space on the periphery of the driveshaft formed between the packing and the shaft sealing ring. A solvent-containing fluid is used here as blocking fluid. The modification of the invention is particularly advantageous, in which the annular space is connected to an inlet and outlet via separate guide channels, in which the inlet and outlet are formed on the sealing housing. The gaps between the driveshaft and the housing parts can therefore be advantageously flushed out after changing the blocking fluid.

The modification of the invention, in which a peripheral alignment land is formed on the periphery of the hole of the gear or on the periphery of the driveshaft, through which the gear is held free of play against the driveshaft, has led, in particular, to improvement of the transient behavior of the gear on the housing plates. An additional degree of freedom to execute a compensation movement on the gear can be achieved through the size and position of the alignment land.

The alignment land is preferably arranged in the middle area of the gear and made with an alignment length of less than one-fourth the gear width. Because of this, an oscillating movement in the axial direction of the gear can be achieved, which leads to automatic centering of the gear in the driveshaft via the sealing rings assigned to the front faces. However, manufacturing tolerances can be fully compensated and low-wear and favorable transient behavior of the front face of the gear relative to the housing plates can be achieved.

BRIEF DESCRIPTION OF THE SEVERAL VIEWS OF THE DRAWINGS

The gear pump according to the invention is further explained below by means of some practical examples with reference to the accompanying figures.

In the Figures

DETAILED DESCRIPTION

Figure 1:
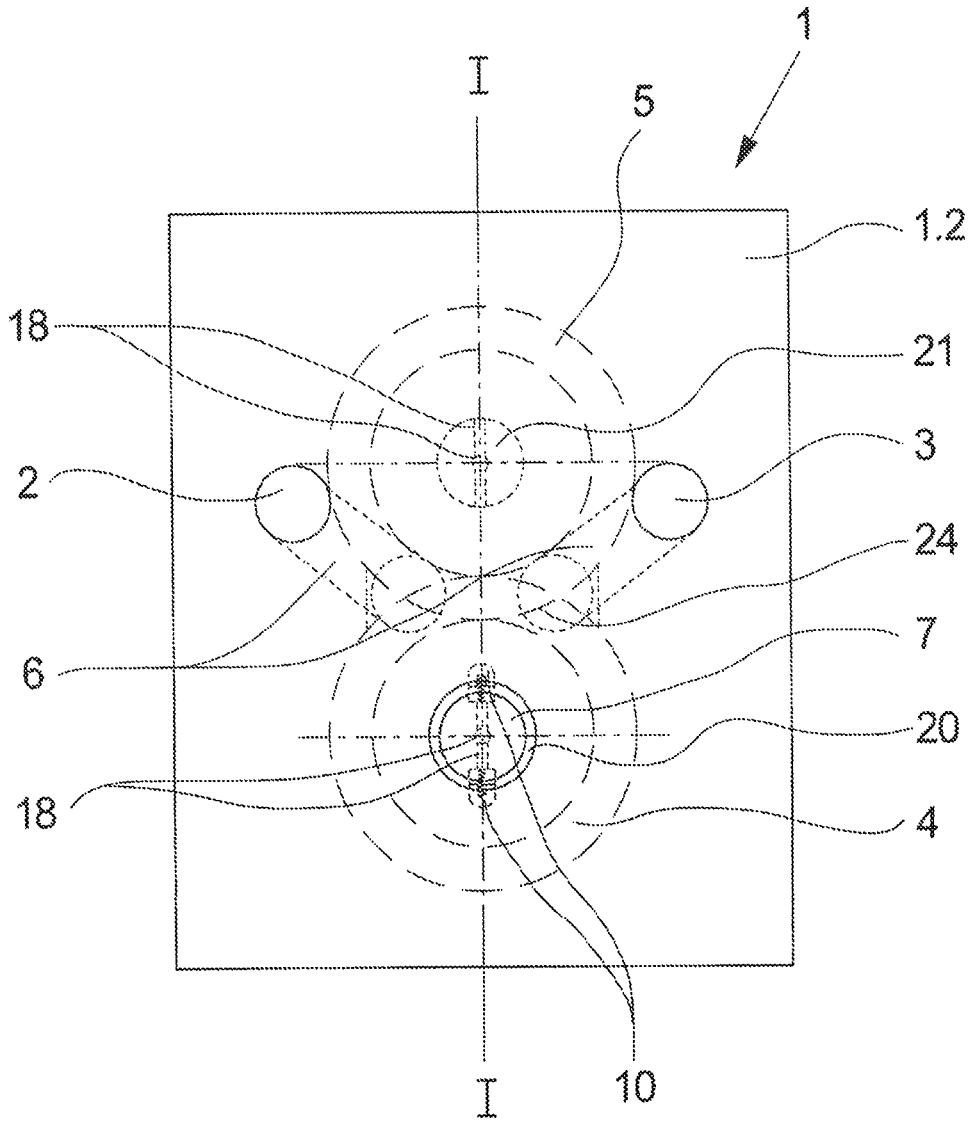
FIG. 1 schematically depicts a view of a first practical example of the gear pump according to the invention FIG. 2 schematically depicts a sectional view of a practical example of the gear pump according to the invention according to FIG. 1
Figure 2:
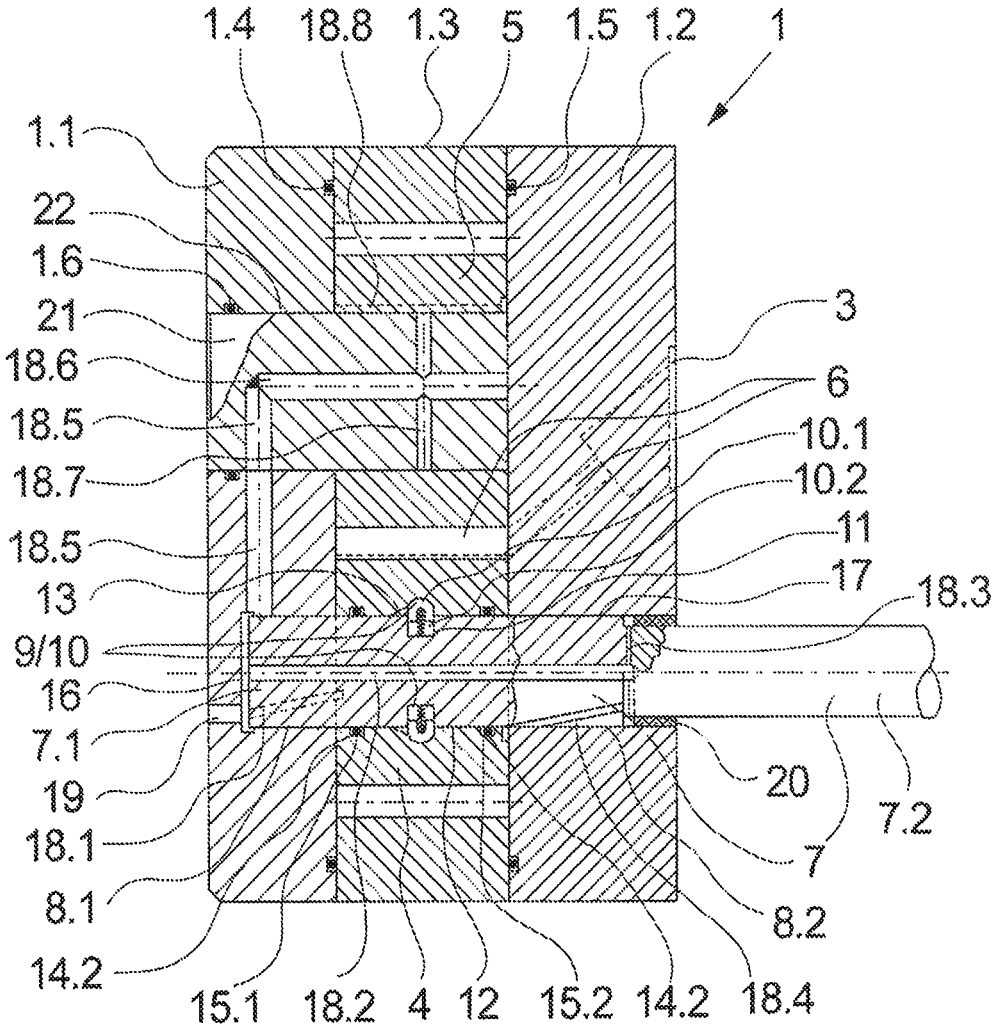

A first practical example of the gear pump according to the invention is shown in FIG. 1 and FIG. 2. FIG. 1 shows a view of the gear pump and FIG. 2 a cross-sectional view of the gear pump. To the extent no explicit reference to one of the figures is made, the following description applies to both figures.

The gear pump has a pump housing 1 designed in several parts and consists of housing plates 1.1 and 1.2, as well as the center plate 1.3 held between housing plates 1.1 and 1.2. In the front faces of housing plates 1.1 and 1.2, a sealing ring 1.4 and 1.5 is arranged, through which the gap between the center plate 1.3 and the housing plates 1.1 and 1.2 are sealed outward.

The center plate 1.3 has recesses for two intermeshing gears 4 and 5. A feed channel system 6 is formed in the overlapping area of gears 4 and 5 in the housing parts, which is connected to a pump inlet 2 formed in housing plate 1.2 and a pump outlet 3, also formed in housing plate 1.2. The feed channel system 6 is preferably formed by holes and recesses in the housing plates 1.1 and 1.2, as well as center plate 1.3.

The gear 5 is mounted to rotate on a fixed journal 21. The journal 21 is held for this purpose in a alignment hole 22 in housing plate 1.1. Sealing ring 1.6 is provided between housing plate 1.1 and journal 21.

The second gear 4 is splined to a driveshaft 7. For this purpose, the gear 4 is penetrated in a middle hole 12 by driveshaft 7. A connection device 9 is provided between the periphery of driveshaft 7 and hole 12 of gear 4, through which a shape-mated and splined connection is formed between the driveshaft 7 and gear 4.

In this practical example of the gear pump according to the invention, the connection device 9 is formed by a detent 10.

The detent 10 has a detent element 10.1 introduced to a shaft recess 11 at several locations of the periphery of driveshaft 7, which is loaded with a spring 10.2 that acts radially outward. In the operating position depicted in FIG. 2, the detent element 10.1 is held by spring 10.2 in a recess 13 of hole 12 of gear 4. The recess 13 in hole 12 of gear 4 is adapted to the detent element 10.1, so that during rotation of driveshaft 7, the gear 4 is driven. In the depicted practical example, the detent 10 is formed by two detent elements 10.1, each arranged 180° offset on the periphery of the driveshaft.

The driveshaft 7 has for this purpose a bearing end 7.1 and a coupling end 7.2. The bearing end 7.1 of the driveshaft 7 is mounted to rotate within the pump housing. The coupling end 7.2 of the driveshaft 7 extends outside of the pump housing 1 for coupling to a drive not shown here. The bearing end 7.1 of the driveshaft 7 is secured with one free end in a bearing blind hole 16 on housing plate 1.1 and forms a first bearing position 8.1. On the opposite side of gear 4, the driveshaft 7 is mounted to rotate in the housing plate 1.2 in a continuous bearing hole 17 in a second bearing position 8.2. Toward the outside of the housing plate 1.2, a shaft seal 20 is provided outside bearing position 8.2 between the driveshaft 7 and the housing plate 1.2, so that the free coupling end 7.2 of the driveshaft 7 is guided pressure-tight outward to a drive. Between the bearing position 8.2 and the shaft seal 20, a diameter offset is formed in driveshaft 7.

Between the rotating components within the pump housing 1, like driveshaft 7, gear 4 and gear 5, as well as the non-rotating components, like housing plates 1.1 and 1.2, as well as journals 21, gaps are formed, which are directly or indirectly connected to the feed channel system 6. Such gaps within pump housing 1 permit, depending on the design of the gap seals, slight leakage of the conveyed paint, which penetrates into the gaps between the gears 4 and 5 and housing plates 1.1 and 1.2. In order to prevent penetration of leaks into the gap formed between driveshaft 7 and gear 4 during operation, packings 14.1 and 14.2 are provided on the periphery of the driveshaft 7, which seal off the gap between the gear 4 and driveshaft 7. The packings are designed, so that connection devices 9 provided between the gear 4 and the driveshaft 7 are situated in a fully sealed area within pump housing 1. The packing in this practical example is formed by two sealing rings 14.1 and 14.2 arranged at a spacing to each other. The sealing rings 14.1 and 14.2 are each held in sealing grooves 15.1 and 15.2 that are introduced on the radial periphery into hole 12 of the gear 4. The sealing grooves 15.1 and 15.2 are then assigned to the corresponding front sides of gear 4, so that the gap forming between driveshaft 7 and gear 4 is essentially sealed over its entire width. The distance between sealing rings 14.1 and 14.2 is made smaller here than the width of gear 4. In principle, however, there is also the possibility that the sealing rings 14.1 and 14.2 are assigned directly to the front sides of gear 4, so that the distance between sealing rings 14.1 and 14.2 is essentially the same as the width of gear 4.

In addition to the feed channel system 6 related to operation within the pump housing, an additional flushing channel system with a number of flushing channels is formed in the housing plates 1.1 and 1.2, as well as in the driveshaft 7 and journal 21, in order to flush a flushing agent supplied from the outside through a closeable feed 19 to flush the gaps between the rotating and fixed components within pump housing 1. Such a flushing channel system in a gear pump is known, for example, from EP 1 164 293 B1, so that reference to the description mentioned there can be made at this point.

In the practical example depicted in FIG. 2, the feed 19 discharges into a recess of the bearing blind hole 16. The flushing agent is directly guided from bearing blind hole 16 through a flushing channel 18.1 designed as a groove to the gap formed in the bearing position 8.1 between driveshaft 7 and housing plate 1.1. The bearing position 8.1 is traversed from the outside in by the flushing agent. The second bearing position 8.2 formed in housing plate 1.2 is connected to feed 19 via flushing channels 18.2, 18.3 and 18.4. The flushing channels 18.2 and 18.3 are designed as holes within the driveshaft 7, in order to feed the flushing agent into an annular space formed between shaft sealing ring 20 and bearing position 8.2. The flushing channel 18.4 is designed as a groove on the periphery of driveshaft 7 and extends over the entire bearing position 8.2, so that the flushing agent traverses the bearing position 8.2 from the outside in. An additional penetration of flushing agent into the gaps is prevented by sealing rings 14.1 and 14.2 arranged on the periphery of the driveshaft. The flushing agent is guided in the feed channel system 6 via the gaps formed between the front faces of gear 4 and housing plates 1.1 and 1.2. Discharge of the flushing agent can therefore be accomplished via the pump inlet 2 and the pump outlet 3.

To flush this bearing gap formed between journal 21 and gear 5, additional flushing channels 18.5, 18.6, 18.7 and 18.8 are provided. Flushing channels 18.5, 18.6 and 18.7 are formed by holes in the housing plate 1.1 and journal 21, in order to connect the gap formed between gear 5 and journal 21 to feed 19. The flushing channel 18.8 is designed as an axially running groove in the gear hole of gear 5, so that the entire support area of gear 5 can be flushed.

The practical example of the gear pump depicted in FIGS. 1 and 2 is particularly suitable, in order to convey paints in painting systems, in which a frequent paint change is required to change the color. Through the configuration of the gaps and flushing channels, all areas of the gear pumps are readily accessible before a paint change, in order to flush out paint residues.

Figure 3:
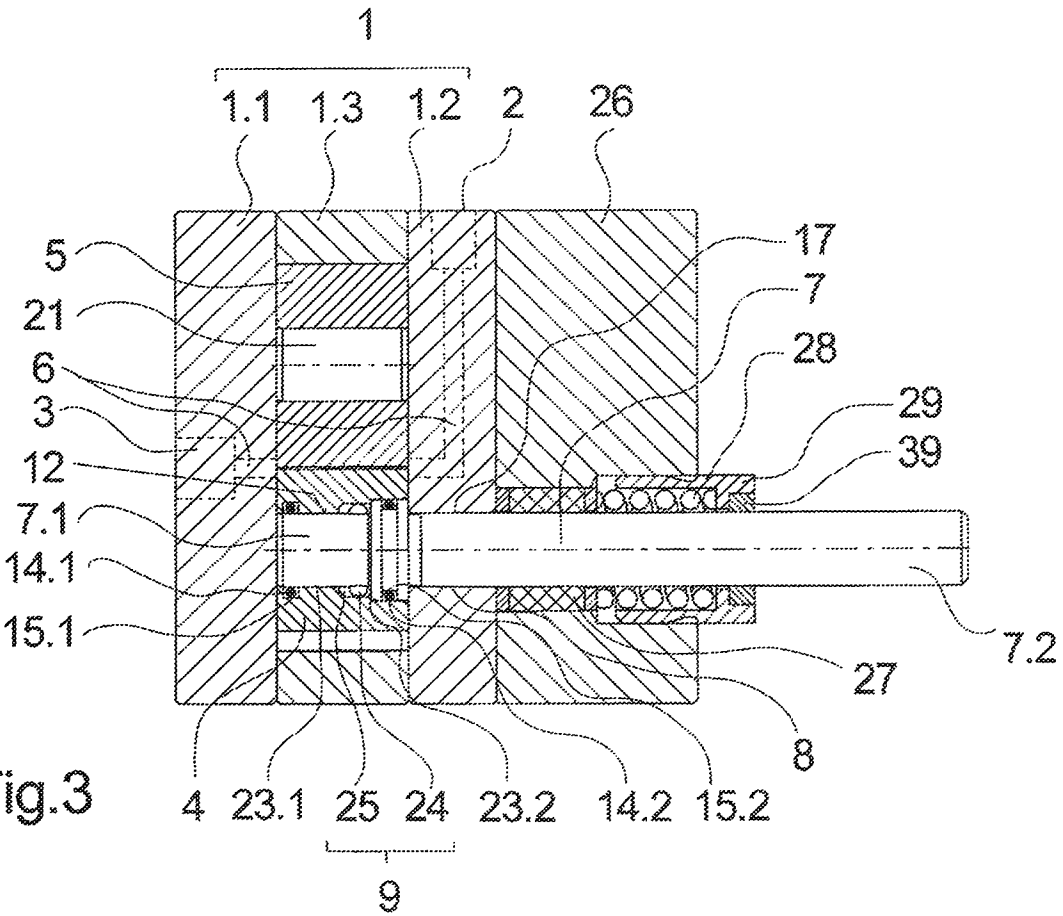
FIG. 3 schematically depicts a sectional view of another practical example of the gear pump according to the invention FIG. 4 and FIG. 5 schematically depict several sectional views of another practical example of the gear pump according to the invention FIG. 6 schematically depicts a sectional view of another practical example of the gear according to the invention.

Another practical example of the gear pump according to the invention is shown in a cross-sectional view in FIG. 3. The practical example according to FIG. 3 also has a multipart pump housing 1, formed by the housing plates 1.1 and 1.2, as well as the center plate 1.3, as well as a sealing housing 26. The sealing housing 26 is connected pressure-tight to housing plate 1.2. Gears 4 and 5 are held in a recess of center plate 1.3 between housing plates 1.1 and 1.2. The pump inlet 2 is formed in the housing plate 1.2 and the pump outlet 3 oppositely in housing plate 1.1. The holes forming the feed channel system 6 here are introduced to housing plate 1.2 and 1.1.

The gears 4 and 5 are held between housing plates 1.1 and 1.2. The driven gear 4 is coupled directly to bearing end 7.1 on a driveshaft 7. The driveshaft 7 and the hole 12 of gear 4 have several diameter steps 23.1 and 23.2. In the transitional area of diameter steps 23.1 and 23.2, an axially running shaped groove 25 is provided within hole 12, in which a pin 24 of driveshaft 7 engages. The pin 24 is connected for this purpose firmly to driveshaft 7 and extends beyond the periphery of diameter step 23.1. The shaped groove 25 provided in hole 12 of gear 4 and the pin 24 fastened on the periphery of driveshaft 7 in this case form the connection device 9, in order to obtain a splined, shape-mated connection between driveshaft 7 and gear 4.

For sealing of the gap formed between driveshaft 7 and gear 5, two sealing rings 14.1 and 14.2, spaced from each other, are provided. The sealing ring 14.1 is held in the diameter step 23.1 in a sealing groove 15.1 on the periphery of hole 12. The sealing ring 14.2, on the other hand, is held in the diameter step 23.2 in a sealing groove 15.2 on the periphery of driveshaft 7.

The driveshaft 7 penetrates housing plate 1.2 in a support hole 17 and forms a bearing position 8 of driveshaft 7. The driveshaft 7 then penetrates the sealing housing 26. Within sealing housing 26, a shaft seal in the form of a gland packing 27 is arranged concentrically to support hole 17 on the periphery of driveshaft 7. The gland packing 27 is biased on one side by a clamping device 28 in the axial direction and forced against housing plate 1.2. The clamping device 28 in the form of a spring is held via a clamping sleeve 29 in the periphery of driveshaft 7 and fixed relative to the sealing housing 26. The coupling end 7.2 of driveshaft 7 is made freely protruding. A shaft sealing ring 39 is provided on the end of the clamping sleeve 28.

The gear 5 meshing with the driven gear 4 is held on the journal 21. The journal 21 has a smaller width relative to gear 5 and is firmly pressed into the hole of gear 5, so that the gear 5 is guided only through housing plates 1.1 and 1.2 and through center plate 1.3 and driven by gear 4.

In the gear pump depicted in FIG. 3, during feed of a paint, gear 4 is driven by driveshaft 7. A paint supplied via pump inlet 2 is conveyed by the meshing gears 4 and 5 into the feed channel system 6 under pressure to pump outlet 3. The leakage emerging from the feed channel 6 via the gap between the front faces of gears 4 and 5 and the housing plates 1.1 and 1.2 is held back by the packings 14.1 and 14.2 arranged between the driveshaft 7 and gear 4, so that the gap between gear 4 and driveshaft 7 remains free of leaks, especially in the area of connection device 9.

In order to free the gap within the pump housing from paint residues during a paint change, there is also the possibility of designing the gear pump depicted in FIG. 3 with a flushing channel system. In this case, the gap formed in the bearing position 8 between driveshaft 7 and housing plate 1.2, as well as the gaps formed between the front faces of gears 4 and 5 and housing plates 1.1 and 1.2, are traversed by a flushing agent. The flushing channel system would preferably be connected via a separate feed and flushing channel to the feed channel system.

Figure 4:
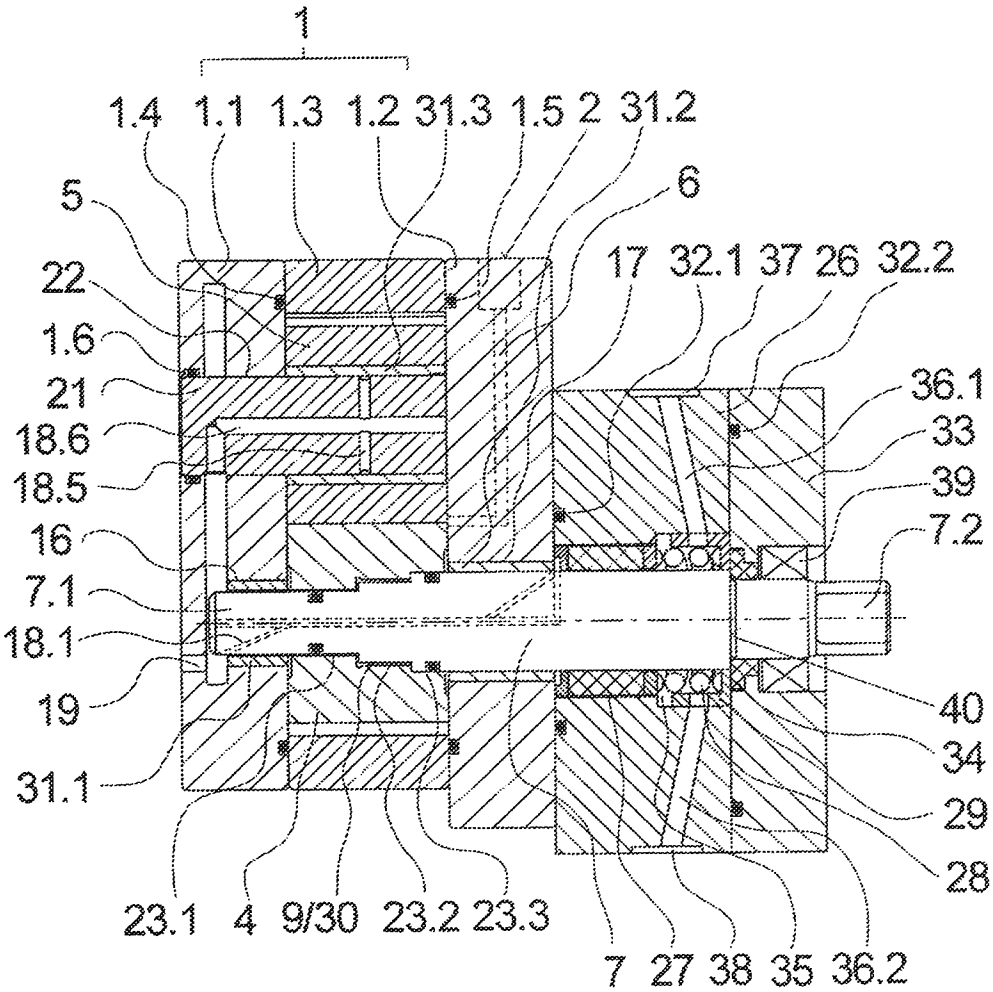
Figure 5:
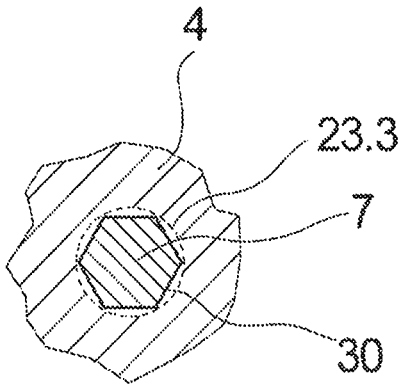

Another practical example of the gear pump according to the invention is shown in FIG. 4 and FIG. 5. The following description applies for both figures to the extent that no explicit reference is made to one of the figures. The gear pump is schematically shown in FIG. 4 in a cross-sectional view. FIG. 5 shows a cutout of the cross-sectional view of the connection between the gear and the driveshaft.

The practical example, in the design of the gear pair of gears 4 and 5, as well as pump housing 1, is essentially identical to the practical example according to FIGS. 1 and 2, so that reference to the aforementioned description is made here and only the differences are explained.

The driveshaft 7 is mounted to rotate via bearing bushings 31.1 and 31.2 in the bearing blind hole 16 of housing plate 1.1 and in the bearing hole 17 of housing plate 1.2. The driven gear 4 is connected via a connection device 9 between the housing plates 1.1 and 1.2 on the bearing end 7.1 of driveshaft 7. The housing plate 1.1, the center plate 1.3 and the housing plate 1.2 are connected to each other pressure-tight, in which a pump inlet 2 is formed on the housing plate 1.2 and a pump outlet (not shown here) on housing plate 1.1, which are connected to each other within the pump housing 1 via a feed channel system 6.

The rotating gear 5 is mounted on the periphery of journal 21 via bearing bushing 31.3. The journal 21 is held in the alignment hole 22 of housing plate 1.1.

The connection device 9 between driveshaft 7 and gear 4 is formed by a polygonal shape 30. For this purpose, hole 12 of gear 4 and the periphery of driveshaft 7 are graduated in several diameter steps. A first diameter step 23.1 extending from bearing end 7.1 is formed as a sealing surface, in which a peripheral sealing groove 15.1 cooperates on the periphery of driveshaft 7 with a corresponding sealing surface on the hole 12 of gear 4.

In a center diameter step 23.2, a polygonal shape 30 is molded onto the periphery of driveshaft 7 and in hole 12. The polygonal shape 30 is schematically shown in FIG. 5. The polygonal shape 30 is formed here as an example by a hexagon.

As shown in FIG. 4, a second sealing surface is formed between gear 4 and driveshaft 7 in a diameter step 23.3 of larger diameter. For this purpose, the sealing groove 15.2 is formed on the periphery of driveshaft 7, in which the sealing ring 14.2 is held. The sealing ring 14.2 is supported on an opposite sealing surface of hole 12.

The coupling end 7.2 of driveshaft 7 extends from the pump housing 1 on the drive side of the pump housing 1. The coupling end 7.2 of the driveshaft 7 has a diameter offset 40 in the end area, against which a support ring 34 lies. The support ring 34 is designed L-shaped and is held in a recess of a support housing 33.

The support housing 33 is penetrated by driveshaft 7 and extends from the support housing 33 with the free coupling end 7.2 for connection of a drive. For sealing of the coupling end 7.2 of the driveshaft 7 extending from the support housing 33, a shaft sealing ring 39 is arranged within support housing 33 on the periphery of the driveshaft. The support housing 33 is connected pressure-tight to the pump housing 1 via a sealing housing 26. For this purpose, a first housing seal 32.1 is arranged concentric to bearing hole 10 and between the sealing housing 26 and support housing 34, a second housing seal 32.2 is arranged between the pump housing 1 and the sealing housing 26. The sealing housing 26 has a recess made concentric to the driveshaft 7, which serves to accommodate a gland packing 27 arranged on the periphery of the driveshaft 7. The gland packing 27 is supported on the end of the sealing housing 26 facing the pump housing 1 directly on the housing plate 1.2. A clamping device 28 is provided on the opposite end of gland packing 27 on the sealing housing 26.

The clamping device 28 is formed by a spring, which is held via a clamping sleeve 29 in the sealing housing.

An annular space 35 is formed between the gland packing 27 and shaft sealing ring 39. The annular space 35 is connected via two channels 36.1 and 36.2 to an inlet 37 and an outlet 38 in sealing housing 26. The inlet 37 and the outlet 38 are designed closeable, so that in the operating state, a blocking fluid is introduced to the sealing housing 26, through which the annular space 35 is filled. A solvent-containing fluid is preferably used as blocking fluid, in order to release any paint particles within annular space 35 that might emerge through gap leakage, so that hardening in the gap is prevented. In particular, considering a readjustment of the spring tension, the mobility of the gland packing 27 remains guaranteed. In addition, during maintenance and replacement of the blocking fluid, flushing of the annular space 35 can be simply carried out via channels 36.1 and 36.2.

The practical example of the gear pump according to the invention depicted in FIGS. 4 and 5 is particularly suitable in order to carry out metering of paints with high operating pressures. In particular, during use of such gear pumps in painting robots, during a color change, a back-feed is adjusted by the gear pump, in order to initiate a color change. In addition, the forces acting on driveshaft 7 from the outside are taken up by the support bearing of the support ring in support housing 33, so that the gears are free of axial forces in the interior of pump housing 1. The wear phenomena on the driven gear 4 can be reduced, in particular. The support ring 34 can therefore also be replaced by an ordinary roller bearing.

The flushing channel system 18 formed within the pump housing is identical to the practical example according to FIGS. 1 and 2, so that no additional explanation is provided here for this purpose. The unsealed gap between housing plates 1.1 and 1.2, driveshaft 7 and gears 4 and 5 can therefore be advantageously flushed by a flushing agent.

Figure 6:
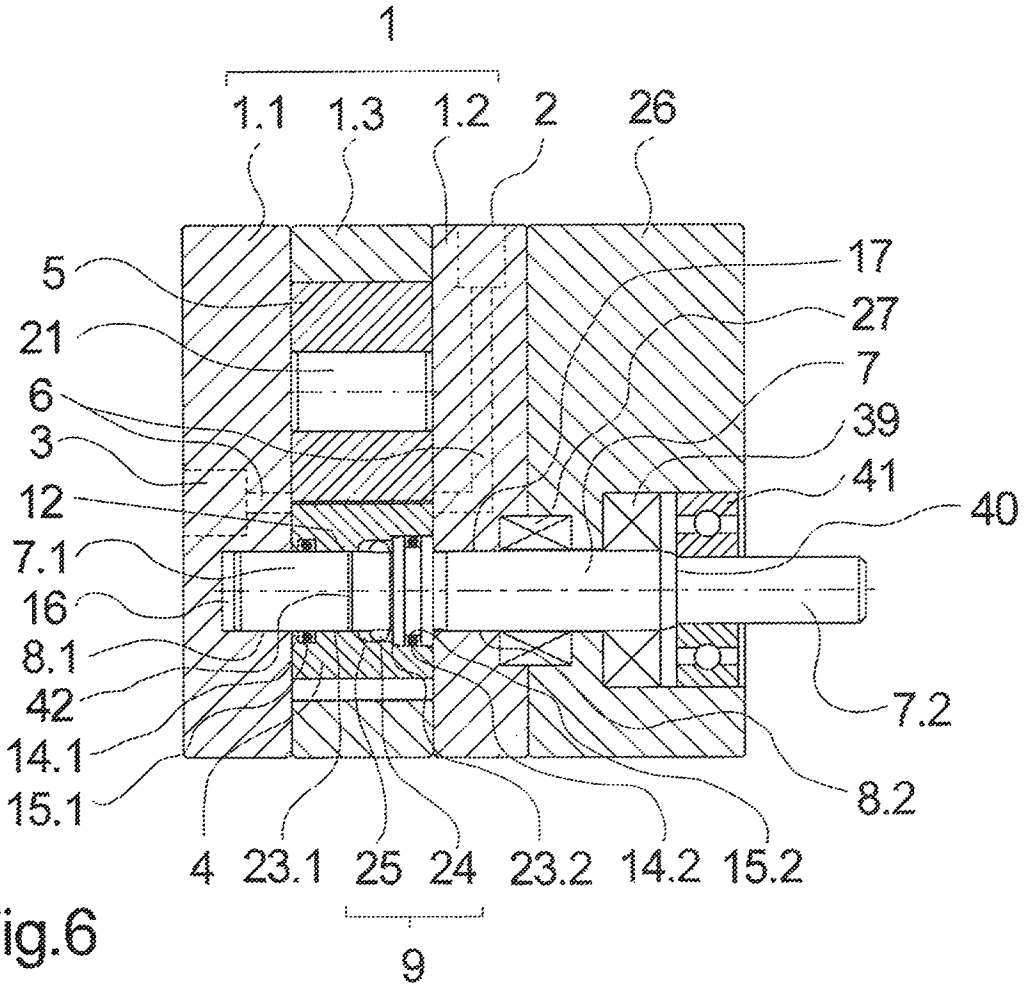

Another practical example of a gear pump according to the invention is schematically depicted in FIG. 6 in a cross-sectional view. The practical example is essentially identical to the practical example according to FIG. 3, so that only the differences will be explained subsequently and otherwise reference is made to the aforementioned description.

The driveshaft 7 in the gear pump depicted in FIG. 6 is supported in bearing positions 8.1 and 8.2 within the pump housing 1 formed by housing plates 1.1, 1.2 and 1.3. The bearing position 8.1 is formed in the housing plate 1.1, which has a bearing blind hole 16 for this purpose. The second bearing position 8.2 is formed by the bearing hole 17 of housing plate 1.2.

The gears 4 and 5 are held between housing plates 1.1 and 1.2. The driven gear 4 is connected via a stepped hole 12 to driveshaft 7. For this purpose, the driveshaft 7 has two diameter steps 23.1 and 23.2. An axially running shaped groove 25 is provided in the transitional area of the diameter steps 23.1 and 23.2 within hole 12, in which a pin 24 of driveshaft 7 engages. A splined shape-mated connection is therefore formed between the driveshaft 7 and gear 4.

A peripheral alignment land 42 is arranged in the diameter section of diameter step 23.1 of driveshaft 7. The alignment land 42 is situated in the middle area of gear 4 and is fitted free of play into the hole 12 of gear 4. In the areas outside of alignment land 42, a small gap is provided between the diameter section of diameter step 23.1 and a hole 12 of gear 4. Between the diameter section of diameter step 23.2 and hole 12 of gear 4, a loose fit is also formed, so that the gear can execute an oscillating movement in the axial direction around the alignment land 42. The oscillating movement of the gear 4 is taken up on both sides of the alignment land 42 by a sealing ring 14.1 and 14.2. The sealing rings 14.1 and 14.2 are arranged for this purpose on the periphery of the driveshaft in the corresponding sections of diameter steps 23.1 and 23.2. Manufacturing tolerances, like plane-parallelism of housing plates 1.1 and 1.2 relative to the gear front sides of gear 4, can therefore be completely compensated. The gear 4 can be guided with particularly low wear between housing plates 1.1 and 1.2.

The driveshaft penetrates the housing plate 1.2 and a sealing housing 26 connected pressure-tight to housing plate 1.2, so that a coupling end 7.2 of driveshaft 7 is held freely protruding for connection of a drive. In the transitional area between housing plate 1.2 and sealing housing 26, a seal is provided as a gland packing 27, which is arranged on the periphery of driveshaft 7 and clamped between the indentations of housing plate 1.2 and sealing housing 26.

An additional support bearing of driveshaft 7 is formed within sealing housing 26. For this purpose, a roller bearing 41 is arranged between sealing housing 26 and driveshaft 7. The roller bearing 4.1 is supported here on a shaft offset 40 of the driveshaft. To seal the support area, a shaft sealing ring 39 is assigned to the roller bearing 41, which is arranged on the periphery of driveshaft 7 on the drive side of the first sealing packing 27.

The practical example depicted in FIG. 6 is therefore particularly suitable, in order to take up the forces acting on the driveshaft 7 by the roller bearing 41 directly outside of pump housing 1. The driven gear 4 can therefore be guided within pump housing 1 free of axial forces. Through the additional oscillating mobility of gear 4, low-wear guiding of gear 4 is possible. In order to achieve sufficient oscillating mobility of the gear on the periphery of driveshaft 7, the alignment land 42 is preferably arranged in the middle area of gear 4 and designed with an alignment length that is less than one-fourth the gear width. The alignment land 42, as an alternative, can also be formed on the periphery of hole 12 of gear 4. In the other areas between driveshaft 7 and gear 4, fitting tolerances are provided, in order to obtain sufficient mobility of gear 4.

All components not further described here of the practical example according to FIG. 6 are essentially identical to the practical example according to FIG. 3. To avoid repetitions, no additional explanations are provided for this purpose. In principle, however, it should be mentioned that the journal 21 of gear 5, as an alternative, can also be held in housing plates 1.1 and 1.2. Likewise, the gear pump has a flushing channel system, not further explained and shown here, in order to be able to execute a rapid and reliable color change during the feeding of paints.

The practical examples of the gear pump according to the invention depicted in FIGS. 1 to 6 are examples in their design and structure of the individual components. In particular, the examples of the connection devices 9 chosen between driveshaft 7 and gear 4 can be replaced by other design solutions. However, it is essential that the gap or gaps forming between the gear and driveshaft are sealed relative to the front sides of the gear, so that no leaks from the outside can reach between the driveshaft and the gear.

The invention claimed is:

1. A gear pump comprising: two intermeshing gears, which are mounted to rotate within a pump housing through a driveshaft and a journal and form a feed channel system between a pump inlet and a pump outlet, and with several gaps formed between the pump housing, the two intermeshing gears, driveshaft and journal, in which one of the several gaps is formed between the driveshaft and one of the two intermeshing gears, and in which a connection device is arranged in the gap for splined connection of the driveshaft to the one gear, wherein the one of the several gaps between the driveshaft and the one gear is sealed to the front ends of the one gear by a packing on each one of the front ends; wherein the packings are formed by at least two sealing rings arranged at a spacing from each other on the periphery of the driveshaft, the spacing between at least two sealing rings being equal to or less than the width of the one of the two intermeshing gears and wherein the at least two sealing rings located within the at least one of the two intermeshing gears.

2. The gear pump according to claim 1, wherein the at least two sealing rings are held in radially peripheral sealing grooves in the periphery of the driveshaft or in radially peripheral sealing grooves in the periphery of a hole of one of the two intermeshing gears.

3. The gear pump according to claim 1, wherein several diameters steps are formed between the driveshaft and one of the two intermeshing gears, in which the connection device between the driveshaft and the one of the two intermeshing gears is held in one of the several diameter steps.

4. The gear pump according to claim 3, wherein the at least two sealing rings are held in the several diameter steps between the driveshaft and the one of the two intermeshing gears, which enclose the several diameter step for accommodation of the connection device.

5. The gear pump according to claim 3, wherein the connection device is formed by a pin, which is firmly connected to the driveshaft and engages in the shaped grove of the one of the two intermeshing gears.

6. The gear pump according to claim 5, wherein the shaped groove of the one of the two intermeshing gears is introduced axially to a hole offset formed between two of the several diameter steps.

7. The gear pump according to claim 3, wherein the connection device is formed by a polygonal shape of the driveshaft, which cooperates with a polygonal shape of a hole of the one of the two intermeshing gears.

8. The gear pump according to claim 1, wherein the connection device is formed by at least one spring-loaded detent, which is held on the periphery of the driveshaft and engages in a recess of a gear hole.

9. The gear pump according to claim 1, wherein a flushing channel system for flushing the gaps within the pump housing is provided, through which a separate feed is connected to the feed channel system.

10. The gear pump according to claim 9, wherein the flushing channel system has several flushing channels, through which several bearing positions of the driveshaft can be flushed from the outside in over their length.

11. The gear pump according to claim 1, wherein the pump housing is designed in several parts, in which the front ends of the gears are held between two housing plates, and in which the driveshaft is held rotatable in the bearing positions, each with a shaft section directly in receiving hole of the housing plates.

12. The gear pump according to claim 1, wherein a sealing housing is arranged pressure-tight on the pump housing, which is penetrated by the driveshaft in a recess made concentric to the driveshaft, and which encloses at least one of the packings arranged on the periphery of the driveshaft.

13. The gear pump according to claim 1, wherein a support bearing for radial and axial support of the driveshaft is formed on a coupling section of the driveshaft protruding outside the pump housing, which is formed by a support ring or a roller bearing.

14. The gear pump according to claim 13, wherein a shaft sealing ring is arranged within a support housing on the periphery of the driveshaft, and wherein the annular space formed between at least one of the packings and the shaft sealing ring is filled with a blocking fluid on the periphery of the drive shaft.

15. The gear pump according to claim 14, wherein the annular space is connected via separate channels to the pump inlet and pump outlet, and wherein the pump inlet and pump outlet are formed on a sealing housing.

16. The gear pump according to claim 1, wherein a peripheral alignment land is formed on a the periphery of a hole of the one gear or on the periphery of the driveshaft, through which the one of the two intermeshing gears is held free of play against the driveshaft.

17. The gear pump according to claim 16, wherein the peripheral alignment land is arranged in the middle area of the one of the two intermeshing gears and has an alignment length less than one-fourth the width of one of the two intermeshing gears.

* * * * *

UNITED STATES PATENT AND TRADEMARK OFFICE

CERTIFICATE OF CORRECTION

PATENT NO. : 9,004,890 B2
APPLICATION NO. : 12/531650
DATED : April 14, 2015
INVENTOR(S) : Tomzik et al.

It is certified that error appears in the above-identified patent and that said Letters Patent is hereby corrected as shown below:

In the claims:

Column 10,
Line 59, Claim 3, “diameters” should read --diameter--.

Column 11,
Line 3, Claim 5, “grove” should read --groove--.

Column 12,
Line 22, Claim 16, “on a the periphery” should read --on the periphery--.

Signed and Sealed this
Fifteenth Day of December, 2015

Michelle K. Lee

Michelle K. Lee
*Director of the United States Patent and Trademark Office*